United States Patent [19]

Schuster et al.

[11] Patent Number: 4,905,837

[45] Date of Patent: Mar. 6, 1990

[54] SEPARABLE DISPLAY CARTON

[75] Inventors: Richard L. Schuster; Lawrence C. Dampier, both of Monroe, La.

[73] Assignee: Manville Corporation, Denver, Colo.

[21] Appl. No.: 308,165

[22] Filed: Feb. 8, 1989

[51] Int. Cl.[4] ..... B65D 3/26

[52] U.S. Cl. ..... 206/606; 206/602; 206/611

[58] Field of Search ..... 206/602, 606, 611, 623, 206/627, 142, 628, 427; 229/132, 40, 136

[56] References Cited

U.S. PATENT DOCUMENTS

| | | | |
|---|---|---|---|
| 2,131,391 | 9/1938 | Schraffenberger | 206/602 |
| 2,217,757 | 10/1940 | Lindley | 229/136 |
| 2,471,883 | 5/1949 | Miessler | 229/132 |
| 2,679,349 | 5/1954 | Mullinix | 206/602 |
| 2,888,132 | 5/1959 | Guyer | 206/627 |
| 2,947,637 | 8/1960 | Foliano | 206/602 |
| 2,967,610 | 1/1961 | Ebert et al. | 206/602 |
| 3,884,348 | 5/1975 | Ross | 206/606 |
| 4,008,849 | 2/1977 | Baber | 206/606 |
| 4,113,100 | 9/1978 | Soja et al. | 206/602 |
| 4,679,726 | 7/1987 | Oliff | 229/40 |

FOREIGN PATENT DOCUMENTS

| | | | |
|---|---|---|---|
| 2541736 | 3/1977 | Fed. Rep. of Germany | 206/602 |
| 2854020 | 7/1980 | Fed. Rep. of Germany | 206/606 |

*Primary Examiner*—Gary Elkins
*Attorney, Agent, or Firm*—John D. Lister

[57] ABSTRACT

A carton adapted to receive rows of articles the bottoms of which are adjacent the side panels of the carton. A tear strip encircling the carton allows the carton to be separated into smaller display packages, each side panel of the carton forming the bottom panel of one of the separated packages. The tear strips in the top and bottom panels are aligned and preferably are at an angle to the side panels so that the front panels of the smaller display packages are low, enabling the first article in the smaller package to be on display. The end panels of the carton are formed of overlapping flaps which contain aligned tear strips. Tuck flaps allow side panel flaps to be connected to the end panels and to be folded in to form a double layer at the side edges.

12 Claims, 4 Drawing Sheets

FIG. 4
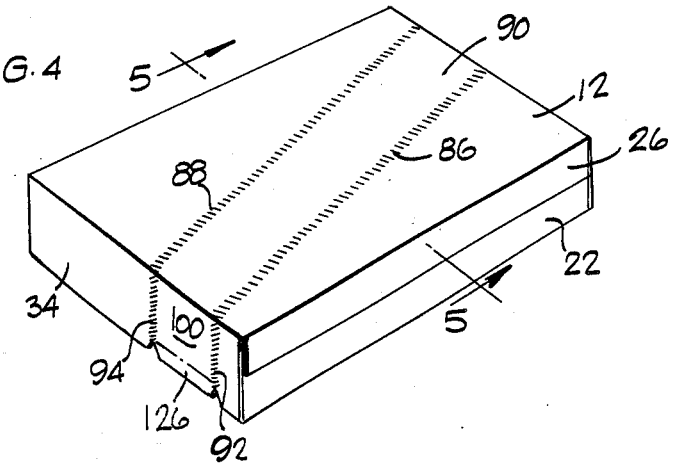
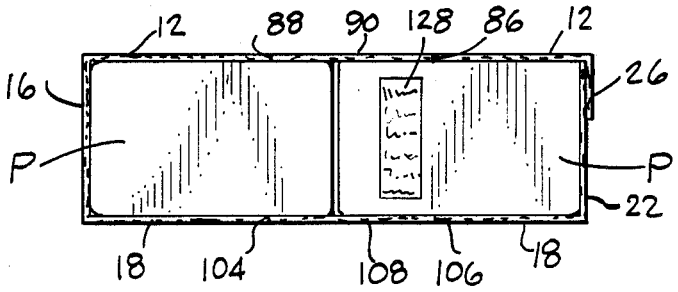
FIG. 5
FIG. 6
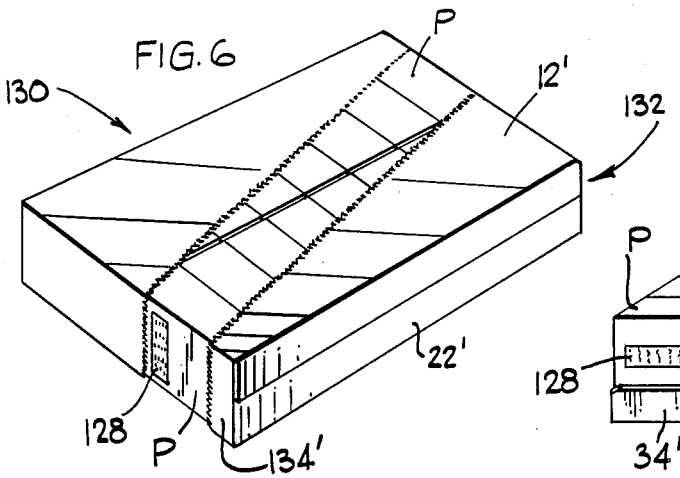
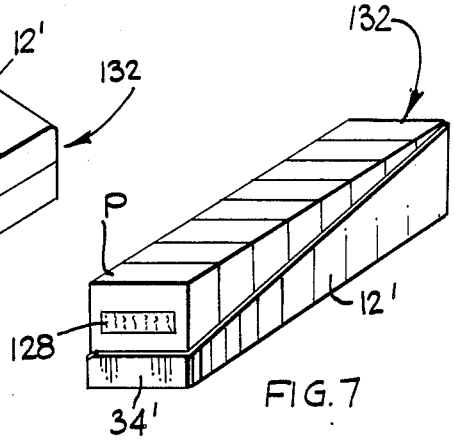
FIG. 7

SEPARABLE DISPLAY CARTON

FIELD OF THE INVENTION

This invention relates to a package for shipping and displaying articles contained therein. More particularly, it relates to a shipping carton which can be separated into smaller display packages, and to a blank for forming the carton.

BACKGROUND OF THE INVENTION

Articles shipped to distributors or retailers generally are packaged in sturdy cartons capable of supporting large quantities of the articles. The cartons are commonly formed of corrugated board, which provides the necessary strength. If it is desired to display the articles, separate display cartons then have to be set up and used. Since this entails an extra expense it is not always feasible to provide separate display cartons.

To reduce packaging costs, combined shipping and display packages have been utilized. The cartons used to form the packages have to be strong enough to support and protect the articles during shipment and in addition be capable of presenting, the articles on display. This has resulted in the use of relatively complicated carton designs which require somewhat involved set-up procedures, often entailing the reassembly of the shipping carton into a different appearing display package. Such combination shipping and display packages are often limited to handling only small numbers of articles.

It would be desirable to be able to ship large quantities of articles in a single shipping carton which can then be very quickly transformed into a display package without requiring intricate or involved set-up procedures.

SUMMARY OF THE INVENTION

This invention overcomes the problems associated with past designs of combination shipping and display cartons by providing a separable carton. The top and bottom panels of the carton are connected to end panels and side panels to form an enclosed carton, and a plurality of rows of the articles to be shipped are loaded in the carton so that the bottoms of the articles are adjacent the side panels of the carton. Each of the top, bottom and end panels contain a tear strip, the tear strips in the end panels connecting with the tear strips in the top and bottom panels to form a substantially continuous tear strip about the periphery of the carton. After removing the tear strip, the remaining carton portions are used as separate display packages, with the side panels of the carton forming the bottom panels of the separated packages.

The tear strips in the top, bottom and end panels are preferably of uniform width, with the tear strip in the top panel being aligned with the tear strip in the bottom panel. In the preferred arrangement the tear strips in the end panels are closer to one side panel than to the other side panel, with the tear strips in the top and bottom panels extending at an angle to the side panels. The tear strips in the end panels of such an arrangement preferably are substantially vertically aligned. When the carton is separated the resulting short front panels of the separated display packages, which were formed from the end panels of the original carton, enable large portions of the first article in the package to be seen. The end panels of the carton preferably are formed from overlapping end flaps, each of which contains an aligned tear strip in the overlapped portion. Further, the blank used to form the carton includes folded-over side panel extensions or reinforcement flaps which, in connection with tuck flaps connected to the end flaps, reinforce the carton to provide additional strength.

The carton is formed from a generally rectangular sheet of material, such as paperboard, which can be folded and secured in place in a very short period of time.

The foregoing features of the invention, as well as other aspects and benefits, will readily be ascertained from the more detailed description of the invention which follows.

BRIEF DESCRIPTION OF THE DRAWINGS

FIG. 4 is a pictorial view of the separable carton of the invention;

FIG. 5 is a transverse sectional view taken on line 5—5 of FIG. 4;

FIG. 6 is a pictorial view similar to that of FIG. 4, but showing the carton, with articles packaged therein, after the tear strip has been removed;

FIG. 7 is a pictorial view of one of the separated display packages containing a row of articles on display.

DESCRIPTION OF THE PREFERRED EMBODIMENT

Figure 1:
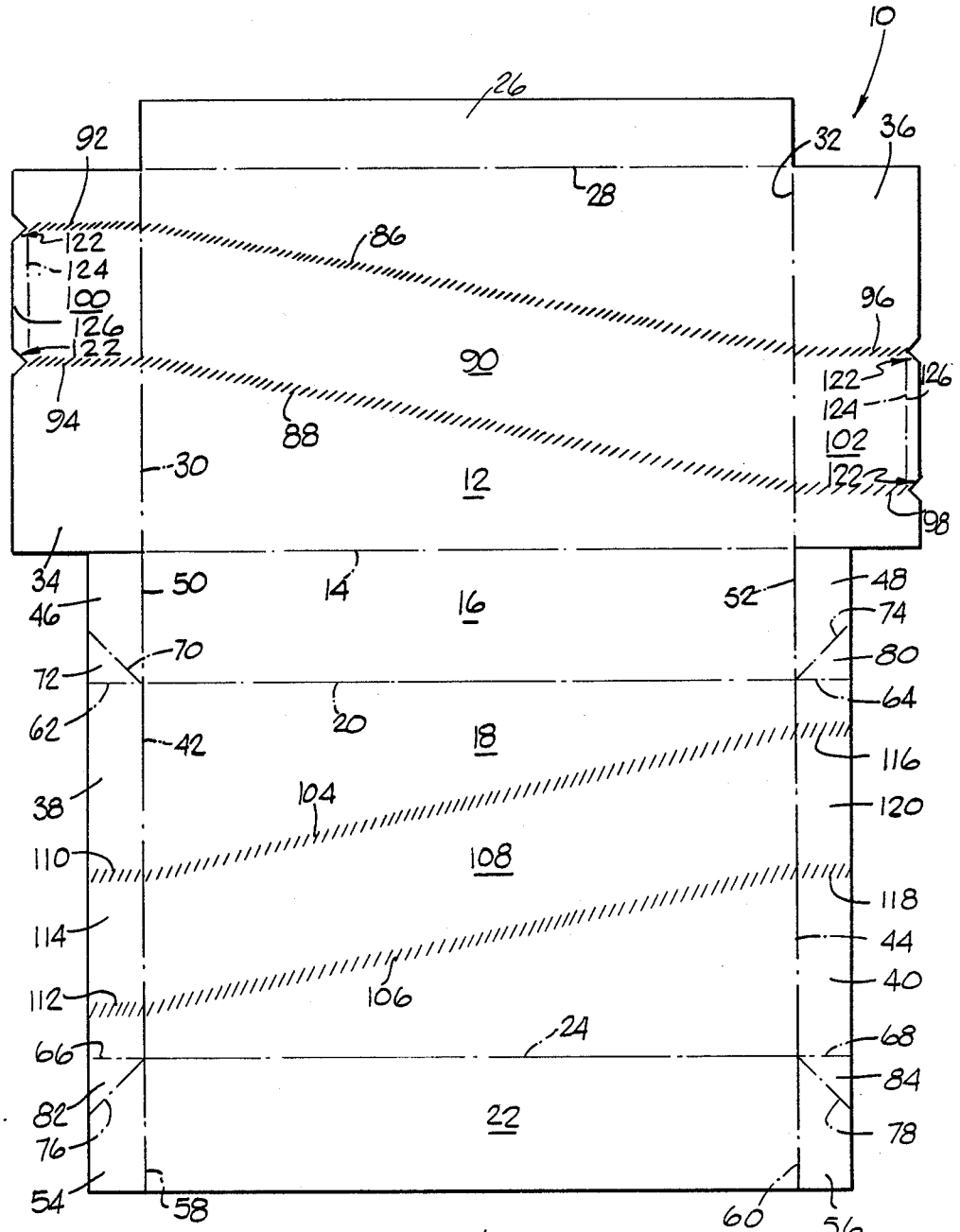
FIG. 1 is a plan view of a blank for forming the separable carton of the invention, the side of the blank which corresponds to the inside surface of the carton being presented to the viewer.

Referring to FIG. 1, a carton blank 10 is comprised of a top panel section 12 connected by a fold line 14 to a side panel section 14, which in turn is connected to a bottom panel section 18 by a fold line 20. The bottom panel section 18 is connected to another side panel section 22 by fold line 24. The width of each side panel section 16 and 22, corresponding to the height of the side panels in a carton formed from the blank, is the same. The widths of the top and bottom panel sections, corresponding to the width of a carton formed from the blank, are also equal, so that the carton is rectangular in cross section.

A glue strip 26 is connected by fold line 28 to the side edge of the top panel section 12 opposite the fold line 14. The fold lines 28, 14, 20 and 24 are parallel to each other.

Connected to the ends of the top panel section 12 along fold lines 30 and 32 are end flaps 34 and 36, respectively. Similarly, end flaps 38 and 40 are connected to the ends of the bottom panel section 18 along fold lines 42 and 44, respectively. The distance that the end flaps 34 and 36 extend outwardly from their fold lines 30 and 32 is greater than the distance that the end flaps 38 and 40 extend from their fold lines 42 and 44. In addition, side panel reinforcement flaps or extensions 46 and 48 are connected to the side panel 16 along fold lines 50 and 52, while side panel reinforcement flaps or extensions 54 and 56 are connected to the side panel 22 along fold lines 58 and 60. The width of the reinforcement flaps 46, 48, 54 and 56 is equal to the width of end flaps 38 and 40. The fold lines 30, 50, 42 and 58 are aligned, as are the fold lines 32, 52, 44 and 60. The reinforcement flaps 46 and 48 are connected, respectively, to the end flaps 38 and 40 along fold lines 62 and 64, which are extensions of the fold line 20. Similarly, the reinforcement flaps 54 and 56 are connected, respectively, to the end flaps 38 and 40 along fold lines 66 and 68, which are extensions of the fold line 24.

The reinforcement flap 46 contains a diagonal fold line 70 extending generally from the intersection of fold lines 20, 50, 42 and 62 to the outer edge of the flap 46 to form a tuck flap or gusset panel 72. Similarly, the reinforcement flaps 48, 54 and 56 contain diagonal fold lines 74, 76 and 78 to form tuck flaps 80, 82 and 84. The diagonal fold lines form an angle of about 45° with the fold lines which they intersect.

The top panel section 12 contains areas or lines of weakness 86 and 88 which create the tear strip 90 therebetween. The lines of weakness may be formed by an suitable conventional method, such as by slitting or perforating the material to a point that allows it to provide adequate support during use as a shipping carton but which can be readily separated by a user lifting and pulling the tear strip. Perforated lines 92 and 94 extend across the width of the end flap 34, joining with the weakened lines 86 and 88, and a similar arrangement is provided in end flap 36 wherein perforated lines 96 and 98 extend across the flap 36, joining with the weakened lines 86 and 88, to form end flap tear strips 100 and 102. The perforated lines in the end flaps 34 and 36 form right angles with the fold lines 30 and 32, respectively, to make the tear strips 100 and 102 extend vertically in a carton formed from the blank. The tear strip 100 is located closer to the end of the blank than to the side panel section 16, while the tear strip 102 is located closer to the side panel section 16 than to the end of the blank, thus causing the tear strip 90 to extend diagonally across the top panel section.

A similar arrangement exists in the bottom panel section 18 and in the end panel flaps 38 and 40. Perforated lines 104 and 106 create the diagonally extending tear strip 108, while perforated lines 110 and 112 form tear strip 114 in end flap 38 and perforated lines 116 and 118 form tear strip 120 in end flap 40. As in the other tear strip arrangement, the tear strips 114 and 120 extend at right angles to the fold lines 42 and 44. Any convenient structure enabling the tear strip to be initially grasped and pulled can be provided. For example, notches or slots 122 extending diagonally from the intersections of perforated lines 92 and 94 with score line 124 forms a tab 126 at the end of the tear strip 100. A similar arrangement may also be provided at the end of tear strip 102.

Figure 2:
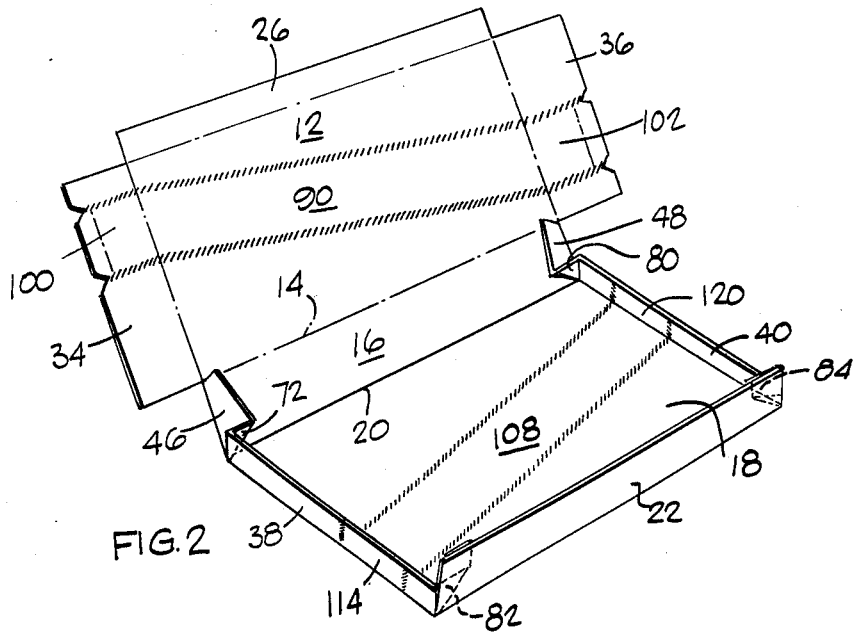
FIG. 2 is a pictorial view of the blank of FIG. 1 shown in an initial stage of carton fabrication.

Referring to FIGS. 1 and 2, with the surface of the blank facing the viewer in FIG. 1 being the inside surface of the blank, the first step in folding the blank 10 to form a carrier is to push the tuck flaps 72, 80, 82 and 84 inwardly and upwardly. This causes the paperboard to fold along the fold lines defining the tuck flaps, moving these fold lines up out of the plane of the blank and raising the end panel flaps 38 and 40 and the side panel reinforcement flaps 46, 48, 54 and 56. It also causes the side panel section 16 and the top panel section 12 to be hinged up as a unit about score line 20, and the side panel section 22 to be hinged up about the score line 24. The side panel reinforcement flaps are continued to be folded about score lines 50, 52, 58 and 60 until they overlie the adjacent side panel sections as shown in FIG. 2. It should be understood that although articles to be packaged are not shown in FIG. 2 so as not to interfere with the illustration of the carrier components, in actual practice the articles would first be positioned on the bottom panel section of the blank, after which the folding would proceed as outlined above. The blank is thus folded or wrapped around the articles in forming the carton.

Figure 3:
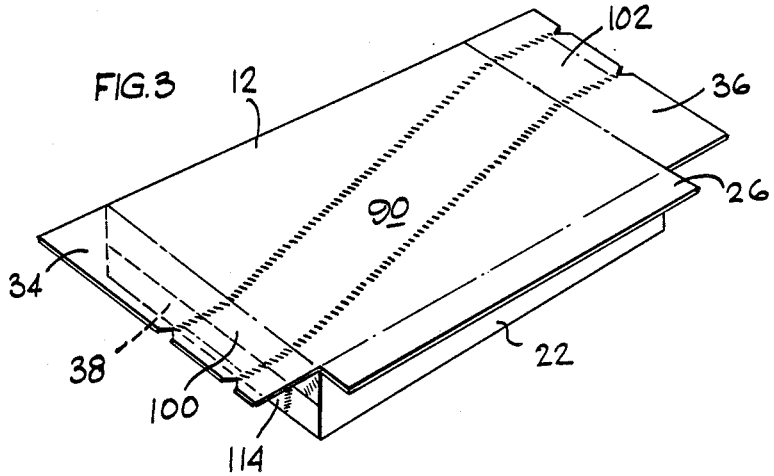
FIG. 3 is a pictorial vview of the blank of FIG. 1 in a later stage of fabrication.

The blank in the intermediate form of FIG. 2 is continued to be folded along fold lines 20 and 24 to bring the side panel sections 16 and 22 up to vertical, and is then folded about fold line 14 to form the intermediate configuration shown in FIG. 3. The tuck flaps at this point are face to face with the adjacent portions of the reinforcement flaps 46, 48, 54 and 56, and the top panel section 12 is in its final position. The end panel flaps 38 and 40 are held in erect vertical position by the connected folded tuck flaps. The articles in the carrier, which are tightly packed and abut the side panels 16 and 22, also abut the tuck flaps, pushing against them and pinning them against the adjacent folded-over side panel reinforcement flaps. Thus the articles in the package assist in holding the tuck flaps in position.

The top end panel flaps 34 and 36 are then folded down to overlap and be glued to the bottom end panel flaps 38 and 40. Preferably, the tear strips 100 and 102 are only tacked or lightly glued to the corresponding tear strips 114 and 120 for ease of subsequent tearing. The glue strip 26 is also folded down and glued to the top portion of side panel 22. The resulting carton is illustrated in FIG. 4. It will be seen from FIGS. 2, 3 and 4 that the tear strip 90 in the top panel 12 is vertically aligned with the bottom tear strip 108, and that the tear strips 100 and 102 in the top end flaps 34 and 36 are aligned with the tear strips 114 and 120 in the bottom end flaps 38 and 40. As shown in FIG. 5, two adjacent rows of rectangularly shaped articles P have been packaged in the carton so that their bottoms are adjacent the side panels of the carton, with the articles in the right row facing front and the articles in the left row facing in the opposite direction. The latter arrangement is illustrated in FIG. 5 wherein the label or legend 128 on the article P denotes the front face of the article.

To convert the shipping carton of FIG. 4 into two display cartons it is merely necessary to lift and pull up one of the tabs 126 to start removing either the tear strip 100 or the tear strip 102 along its perforated edges. Contnued tearing removes the tear strips completely around the periphery of the carton. The overlapping tear strips in the end panels are readily removed along their overlying perforated edges.

This leaves the carton in the condition shown in FIG. 6, wherein two display cartons 130 and 132 have been formed. As shown in FIG. 7, the display carton 132 has one side panel 12′ corresponding to one of the remaining portions of the top panel 12 of the shipping carton and an opposite side panel, not visible, corresponding to the associated remaining portion of the bottom panel 18 of the original shipping carton. The bottom panel 22′ of the display carton corresponds to the side panel 22 of the shipping carton, while the front panel 34′ of the display carton corresponds to the smaller remaining portion of the end panel 34 of the shipping carton. Because the front panel 34′ is short, the leading article P in the row held by the display carton 132 can readily be viewed. It will be understood that the other display carton 130 is identical to the display carton 132, with the back panel of the display carton 130 corresponding to the larger remaining portion of the end panel 34 of the shipping carton and the front panel corresponding to the smaller remaining portion of the opposite end panel 36. Since the left row of articles has been packaged facing toward the end panel 36 of the shipping carton, they will be facing toward the front of the display carton 130.

As shown in FIG. 2, the reinforcement flaps provide a double thickness of paperboard at the edge portions of the side panels of the shipping carton. The tuck flaps add an additional thickness to make a triple thickness of paperboard at the critical locations where the end packages abut the side panels. The end panels are also of double thickness in the overlapping areas of the end panel flaps. These areas of extra thickness add to the strength of the shipping carton.

Figure 8:
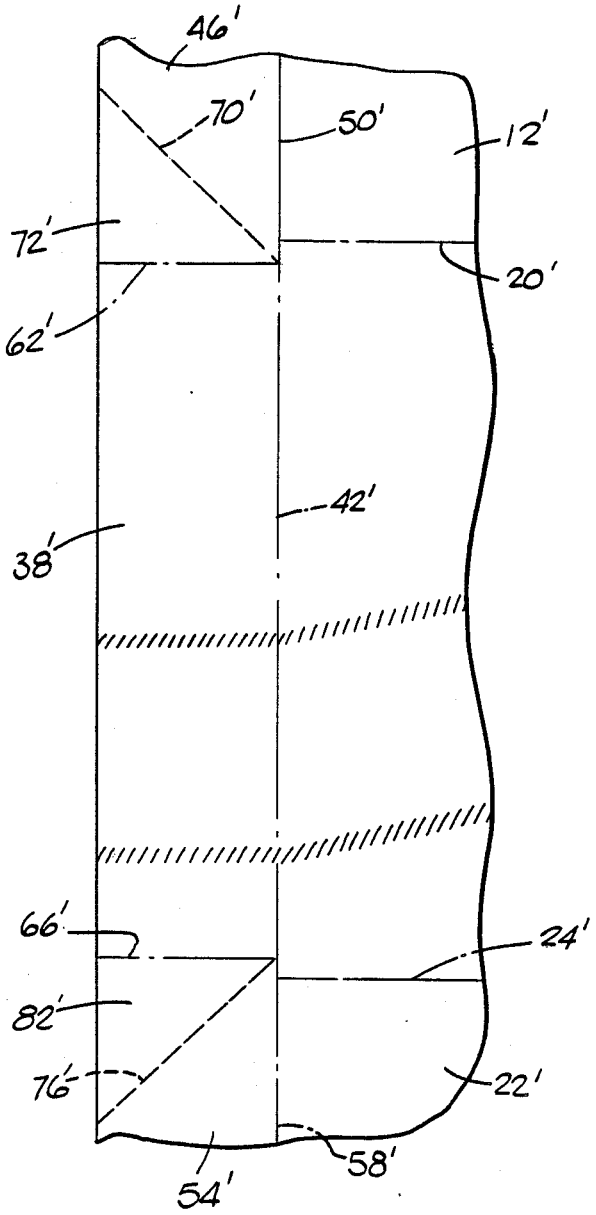
FIG. 8 is an enlarged partial plan view of portion of a modified blank, showing the intersection of the tuck flap fold lines with the fold lines at the edges of the bottom end panel flaps.

In the description of the tuck flaps in connection with the blank of FIG. 1, the diagonal fold lines which form the tuck flaps were stated to form an angle of about 45° with the fold lines they intersect. This is the normal arrangement of tuck flaps, and results in the end panel flaps 38 and 40 being generally vertically disposed. In FIG. 8 a modified arrangement is shown wherein the score lines 70' and 76' are offset from the score lines 20' and 24' so that the distance between the score lines 20' and 24' is greater than the distance between the score lines 62' and 66'. In addition, instead of the diagonal fold line 70' making a 45° angle with the fold lines 50' and 62', it forms an angle less than 45° with the fold line 62' and an angle greater than 45° with the fold line 50'. Similarly, the diagonal fold line 76' forms an angle less than 45° with the fold line 66' and an angle greater than 45° with the fold line 58'. Similar relationships would exist at the other end of the blank. With this arrangement the lower end panel flaps tend to bow slightly inwardly toward the contents of the carrier after the package has been fabricated. This guards against slack end panels and aids in holding the packaged articles tightly in place. The specific angles and offsets that may be used will vary with the size of the package and the amount of inward bias desired, with greater offsets being required with greater angular departures from 45°. It should be understood, however, that the rectilinear arrangement of the panels does not permit large variations from the FIG. 1 embodiment. A preferred design, for example, combines a 3/32 inch offset with a 43° acute angle formed by diagonal fold lines 70' and 76' with fold lines 62' and 66'. In such an arrangement the obtuse angle formed by fold lines 70' and 76' with fold line 42' and its extensions 50' and 58' would be 47° so that the sum of the acute and obtuse angles is always substantially 90°.

It will be appreciated that the tear strip arrangement described in connection with the preferred embodiment need not be llimited to the specific design shown. For example, if the front and back panels of the display cartons are desired to be of equal height, this can be provided by making the perforated edges of the tear strips in the top and bottom panels extend parallel to the side panels of the shipping carton. The height of the display cartons can be controlled by proper adjustment of the width of the tear strip. In any case the tear strips in the end panel flaps should be properly aligned to allow the tear strip sections in the overlapped end panel flaps to be removed as a unit.

It should now be obvious that although a preferred embodiment of the invention has been described, changes to the specific details of the embodiment, in addition to or instead of the possible modifications suggested, can be made without departing from the spirit and scope of the invention as defined by the claims.

What is claimed is:

1. A separable display package carton, comprising:

a top panel and a bottom panel connected to end panels and side panels to form an enclosed carton;

the carton containing a plurality of rows of articles having top portions directed inwardly of the carton and bottoms adjacent the side panels of the carton;

each of the top, bottom and end panels containing a tear strip, the tear strips in each end panel connecting with the tear strips in the top and bottom panels to form a substantially continuous tear strip about the periphery of the carton;

the side panels of the carton, after the substantially continuous tear strip has been removed, comprising the bottom panels of separated display packages, with the bottoms of the articles contained in the separated display packages being supported thereon;

each end panel comprising overlapping end flaps connected to each other in the area of overlap, each end flap containing a tear strip aligned with the tear strip in the associated end flap; and each side panel having reinforcement flaps extending therefrom, the reinforcement flaps being connected to an adjacent end panel flap by foldably connected tuck flaps, the reinforcement flaps being folded in to form areas of double thickness in the side panels adjacent the end panels.

2. A carton according to claim 1 , wherein the tear strips in the top, bottom and end panels are of generally uniform width.

3. A carton according to claim 2, wherein the tear strip in the top panel is aligned with the tear strip in the bottom panel.

4. A carton according to claim 3, wherein the tear strips in the end panels are closer to one side panel than the other side panel, and the tear strips in the top and bottom panels extend at an angle to the side panels.

5. A carton according to claim 4, wherein the tear strips in the end panels are substantially vertically aligned.

6. A carton according to claim 1, wherein the tuck flaps are connected to the end panel flap along fold lines which are spaced apart a distance less than the distance between the side panels of the carton.

7. A generally rectangular blank for forming a separable display package carton, comprising:

a first side panel section connected to a first main panel section along a fold line;

the first main panel section connected to a second side panel section along a fold line;

the second side panel section connected to a second main panel section along a fold line;

one of the first and second main panel sections adapted to be the top panel in a carton formed from the blank, and the other main panel section adapted to be the bottom panel;

end flap means connected to at least one of the first and second main panel sections along fold lines;

the first and second main panel sections and the end flap means containing tear strips therein adapted to form a substantially continuous tear strip in a carton formed from the blank;

a carton formed from the blank being adapted to be separated into smaller display packages by removing the substantially continuous tear strip therefrom, the side panels of such a carton comprising bottom panels of the separated display packages;

the end flap means comprising two end flaps connected along fold lines to opposite ends of the first main panel section and two end flaps connected along fold lines to opposite ends of the second main panel section, two of the end flaps at opposite ends of the blank extending outwardly from the blank a greater distance than the other two flaps, whereby the end flaps at each end of a carton formed from the blank are adapted to overlap each other to form the end panels of such a carton; and a side panel reinforcement flap connected to each opposite end of each side panel section along a fold line, each side panel reinforcement flap being connected to a tuck panel along a diagonal fold line, each tuck flap being connected to an adjacent end flap along a fold line, the side panel reinforcement flaps being adapted to be folded in against the side panels of a carton formed from the blank to form areas of double thickness in the side panels of such a carton adjacent the end panels thereof.

8. A carton blank accoding to claim 7, wherein the tear strips in the first and second main panel sections and in the end flap means are of generally uniform width.

9. A carton blank according to claim 8, wherein the tear strips in the first and second main panel sections are located so that they are aligned in a carton formed from the blank.

10. A carton blank according to claim 9, wherein the tear strips in the end flap means are located so that they are closer to one side panel that the other side panel in a carton formed from the blank and so that the tear strips in the top and bottom panels of such a carton extend at an angle to the side panels.

11. A carton blank according to claim 11, wherein the end flaps extending outwardly from the blank a distance greater than the other two flaps extend outwardly a distance substantially equal to the height of the side panel sections.

12. A carton blank according to claim 7, wherein the fold lines connecting an end flap to tuck flaps are spaced apart a distance less than the distance between the fold lines connecting the bottom panel section to adjacent side panel sections, and wherein the angle formed by a tuck flap diagonal fold line and the fold line connecting the tuck flap to an adjacent end flap is less than 45°.

* * * * *